US006206588B1

(12) United States Patent
Nagahata

(10) Patent No.: US 6,206,588 B1
(45) Date of Patent: Mar. 27, 2001

(54) THERMAL PRINTER

(75) Inventor: Takaya Nagahata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/285,456

(22) Filed: Apr. 2, 1999

(30) Foreign Application Priority Data

Apr. 3, 1998 (JP) ..... 10-091288

(51) Int. Cl.[7] ..... B41J 2/315

(52) U.S. Cl. ..... 400/120.09; 400/120.05; 400/120.06

(58) Field of Search ..... 400/120.09, 120.05, 400/120.06, 120.01, 120.02, 120.1

(56) References Cited

U.S. PATENT DOCUMENTS 4,141,018 * 2/1979 Mizuguchi et al. ..... 346/76
4,395,146 * 7/1983 Arai ..... 400/121
4,738,553 * 4/1988 Uemura et al. ..... 400/120
5,669,720 * 9/1997 Negishi et al. ..... 400/120.05
5,702,188 * 12/1997 Watanabe et al. ..... 400/120.05

* cited by examiner

*Primary Examiner*—John S. Hilten
*Assistant Examiner*—Charles H. Nolan, Jr.
(74) *Attorney, Agent, or Firm*—Morgan, Lewis & Bockius LLP

(57) ABSTRACT

A thermal printer comprises a plurality of heating elements for heating a recording medium to form an image thereon, an electric motor for transporting the recording medium to a direction opposite to a subscanning direction by rotating a predetermined angle each time a driving pulse is input, and an activating control section for dividing the plural heating elements into a plurality of groups and for activating every the groups of the heating elements in sequence asynchronously such that the sequential activating of all the groups is repeated more than once while each time the driving pulse is turned on.

19 Claims, 8 Drawing Sheets

THERMAL PRINTER

BACKGROUND OF THE INVENTION

1. Technical Field of the Invention

This invention relates to a thermal printer comprising a large number of heating elements made of resistors, etc., and an electric motor for transporting recording paper little by little at the recording time.

2. Description of the Related Art

A thermal printer comprising a large number of heating elements divided into groups for activating the groups at different timings (asynchronously) in a time-divisional manner to reduce current capacity of a power supply, etc., is available.

On the other hand, for example, a thermal printer for recording while transporting recording paper one line at a time by a stepping motor may record in both stopping and moving periods of recording paper to raise the recording speed.

In a thermal printer in a related art for activating heating elements in a time-divisional manner and recording also in the moving period of recording paper, all groups are activated only through one order every turn-on period of a driving pulse of a stepping motor. For example, to divide a large number of heating elements of a thermal print head into a left group and a right group relative to the center of the longitudinal direction of the thermal print head and activate the left and right groups separately (each once), a first strobe signal STB1 is turned on once for activating the left heating elements and then a second strobe signal STB2 is turned on once for activating the right heating elements every turn-on period of a driving pulse of a stepping motor, as shown in FIG. 11, or a first strobe signal STB1 is turned on more than once for activating the left heating elements and then a second strobe signal STB2 is turned on more than once for activating the right heating elements every turn-on period of a driving pulse, as shown in FIG. 12.

However, with the thermal printer in the related art, there occurs unevenness in density on a recorded image because the rotation operation of the stepping motor is unstable; high-quality recording cannot be accomplished.

That is, the rotation speed of the stepping motor is not always constant during the turn-on period of a driving pulse and varies considerably. Particularly, inexpensive stepping motors must often be adopted to reduce the manufacturing costs of the thermal printers. In such a case, the rotation speed of the stepping motor varies hard and even the time between the rising edge of a driving pulse and the rotation start of the actual rotation shaft of the stepping motor is not constant, causing large variations to occur. However, if all groups are activated only through one order every turn-on period of a driving pulse of the stepping motor as in the thermal printer in the related art, the rotation speed of the stepping motor during the activating period varies remarkably from one group to another; for example, the left half portion of an image recorded on recording paper becomes remarkably darker than the right half portion.

SUMMARY OF THE INVENTION

It is therefore an object of the present invention to provide a thermal printer capable of recording with high quality regardless of speed variations of an electric motor for transporting recording paper.

In order to achieve the above object, there is provided a thermal printer having the following aspects.

According to a first aspect of the present invention, there is provided a thermal printer comprising: a plurality of heating elements for heating a recording medium to form an image thereon; an electric motor for transporting the recording medium to a direction opposite to a subscanning direction by rotating a predetermined angle each time a driving pulse is input; and an activating control section for dividing the plural heating elements into a plurality of groups and for activating every groups of the heating elements in sequence asynchronously such that the sequential activating of all the groups is repeated more than once while each time the driving pulse is turned on.

According to a second aspect of the present invention, the number of repetition of the sequential activating is determined so the heating elements as to attain activating energy which is able to form the image on the recording medium based on a resistance thereof and voltage applied thereto.

According to a third aspect of the present invention, the sequential activating of all the groups is repeated three to ten times while each time the driving pulse is turned on.

Thus, sequential activating of all the groups is repeated more than once every turn-on period of the driving pulse input to the electric motor, so that high-quality recording can be executed regardless of speed variations of the electric motor for transporting recording paper.

That is, activating of each group of the heating elements is executed at least twice at distant positions in time sequence during the turn-on period of the driving pulse, thus the average speed of the electric motor during the activating period of the heating elements is leveled off for each group. Therefore, the recording density difference between the groups lessens and a high-quality image recording can be conducted.

If sequential activating of all the groups is repeated three to ten times every turn-on period of a driving pulse, damage to the heating elements is avoided as much as possible and a higher-quality image recording can be conducted.

That is, considering only improvement in the quality of a recorded image, the number of repetitions of sequential activating of all the groups should be increased as much as possible. However, if the number of repetitions is increased extremely, a similar effect to that of making a direct current substantially flow into the heating elements is produced and damage to the heating elements occur due to overheating. Therefore, the appropriate number of repetitions is about three to ten times.

According to a fourth aspect of the present invention, the activating control section includes: a plurality of drive circuit sections provided so as to correspond to the respective groups of the heating elements for activating the heating element used for forming the image while a strobe signal is turned on; and a strobe signal generating section for generating the strobe signal to be supplied to the respective drive circuit sections in sequence asynchronously.

According to a fifth aspect of the present invention, turn-on periods of the strobe signals adjacent in time sequence are overlapped with each other in a delay time of the drive circuit section while the strobe signals pass once through all the groups of the heating elements.

According to a sixth aspect of the present invention, the overlapped time is approximately 5–10 $\mu$sec.

In this configuration, a power supply can be driven stably and efficiently.

That is the drive circuits are configured so as to make the actual activating of the heating elements delayed about 5–10

μsec from the time of the rising edge of the strobe signal to suppress rapid change of the current output of the power supply circuit. As the turn-on periods of the strobe signals adjacent in time sequence are thus made to overlap about 5–10 μsec, varying of the current output can be suppressed and intermittent output of the same can be prevented. Thereby, the power supply can be efficiently used.

According to a seventh aspect of the present invention, all the turn-on periods of the strobe signals are overlapped with each other in a delay time of the drive circuit section while the driving pulse is turned on.

In this configuration, the varying of the output current of the power supply circuit can be suppressed during the turn-on period of the motor driving pulse.

According to an eighth aspect of the present invention, the strobe signal generating section supplies the first strobe signal to the drive circuit after a lapse of a predetermined time since the driving pulse is tuned on.

According to a ninth aspect of the present invention, the strobe signal generating section supplies the first strobe signal to the drive circuit section after an eccentricity of a platen roller occurred when the platen roller is started to rotate by the electric motor to transport the recording medium.

In this configuration, the image recording is conducted in a condition wherein the above eccentricity is canceled. Therefore, high quality image recording not including a position shift in the subscanning direction can be conducted.

According to a tenth aspect of the present invention, the strobe signal generating section supplies the first strobe signal having wider pulse width than those of any subsequent strobe signals while the driving pulse is tuned on.

According to an eleventh aspect of the present invention, the pulse width of the first strobe signal is determined as a width necessary for attaining activating energy which is able to form the image on the recording medium.

The coloring on the recording paper is attained when the integral heat of the heating material exceeds a threshold level inherent in the recording paper. Making the width of the strobe signal pulse used for the first activating longer, there is obtained a longer activating time than any subsequent activating and thereby the image formation on the recording paper can be surely attained. The second and the latter subsequent activating are conducted for canceling the density unevenness in the direction perpendicular to the subscanning direction, thereby the quality of recording can be further improved.

According to a twelfth aspect of the present invention, the strobe signal generating section generates each of the strobe signals supplied to the respective drive circuit sections by delaying one strobe signal.

According to a thirteenth aspect of the present invention, a predetermined length of turn-off period is provided between the strobe signals adjacent in time sequence.

According to a fourteenth aspect of the present invention, the activating control section charges a power supply during the turn-off period.

In this configuration, the power supply can be used efficiently.

According to a fifteenth aspect of the present invention, the recording medium is heat-sensitive paper.

According to a sixteenth aspect of the present invention, the recording medium is normal paper, and the plural heating elements thermally transfer the image thereon through an ink ribbon.

According to a seventeenth aspect of the present invention, the plural thermal devices are arranged in a line to constitute a thermal head, and an area of the thermal head on which the plural thermal devices are mounted has a width substantially the same as that of the recording medium.

According to an eighteenth aspect of the present invention, each of the heating elements is defined by a line-shaped heating resistance disposed at one side end of the thermal head, comb-teeth-shaped common electrodes and an individual electrode arranged so as to be inserted between the common electrodes.

According to a nineteenth aspect of the present invention, the electric motor is a stepping motor.

Other features and advantages of the present invention will be apparent from the following description taken in conjunction with the accompanying drawings:

DETAILED DESCRIPTION OF THE PREFERRED EMBODIMENTS

Referring now to the accompanying drawings, there are shown preferred embodiments of the present invention.

Figure 1:
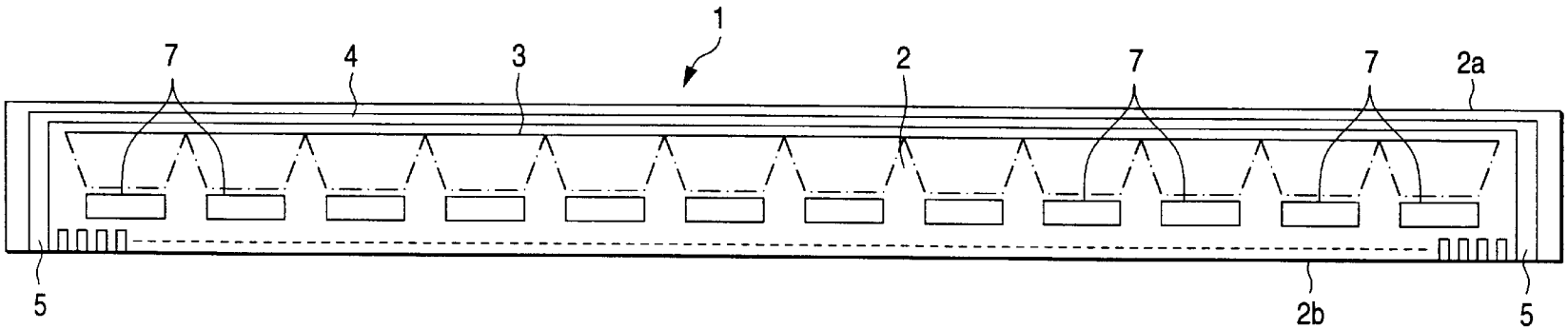
FIG. 1 is a schematic plan view of a thermal print head contained in a thermal printer according to the present invention.

FIG. 1 is a schematic plan view of a thermal print head contained in a thermal printer in a first embodiment of the present invention. A thermal print head 1 has an insulating substrate 2 formed into a long rectangular shape and a heating resistor 3 placed in line along one side end 2*a* of the top face of the insulating substrate 2. A common wiring pattern 4 is placed in a belt-like area between the heating resistor 3 and the one side end 2*a* and is extended at both ends to an opposite side end 2*b* of the insulating substrate 2 and is connected at extension ends to common terminals 5.

Figure 2:
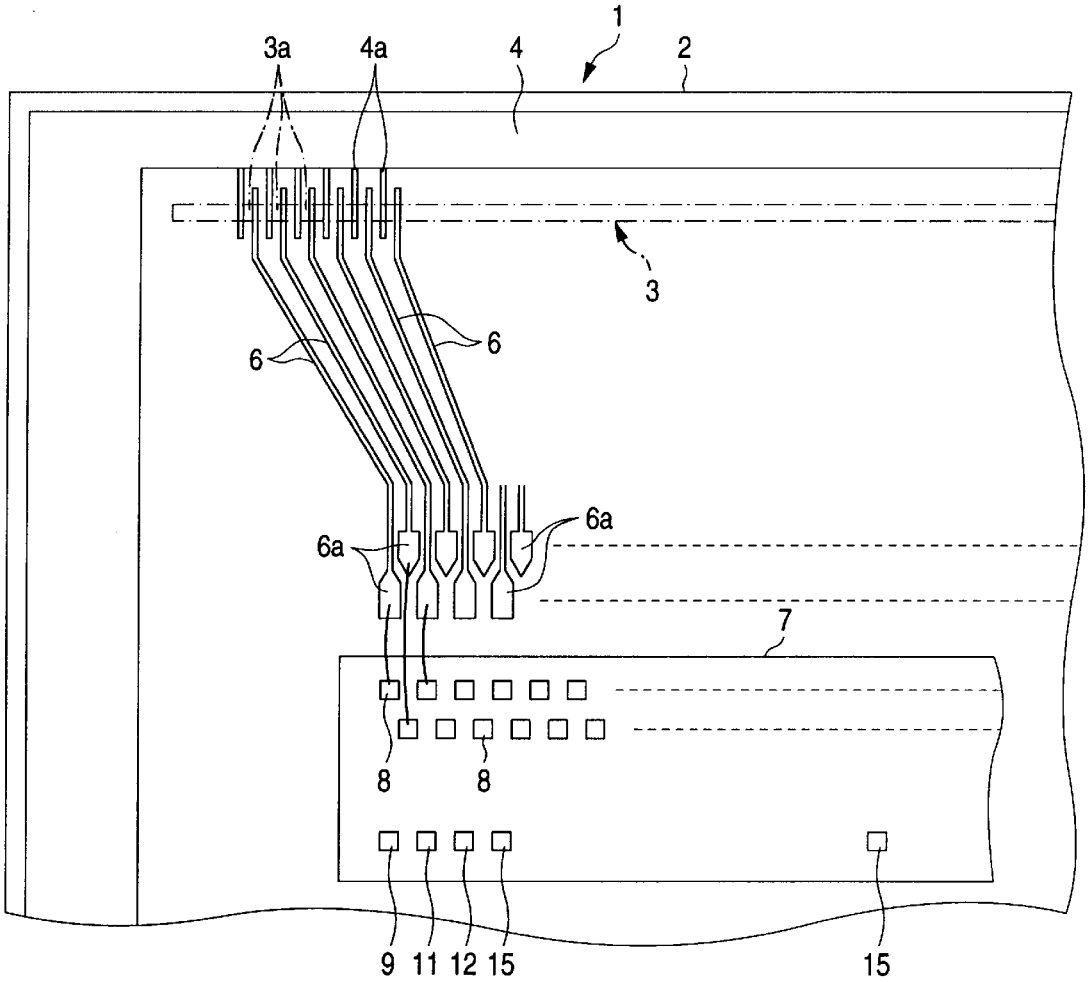
FIG. 2 is an enlarged plan view of one end in a longitudinal direction of the thermal print head shown in FIG. 1.

FIG. 2 is an enlarged plan view of the main part of the thermal print head 1. Comb-teeth-like common electrodes 4*a* are extended from the common wiring pattern 4. On the other hand, individual electrodes 6 are extended at one end so as to be inserted between the common electrodes 4*a* and at an opposite end to the neighborhood of a drive IC 7 mounted on the insulating substrate 2 and is formed at the extension end with a wire-bonding pad 6*a*.

The heating resistor 3 is formed so as to overlap the common electrodes 4*a* and the individual electrodes 6 each inserted therebetween, as indicated by the chain line in FIG. 2. The adjacent common electrodes 4*a* define a heating dot. That is, when any individual electrodes 6 is activated, a current flows into the area of the heating resistor 3 surrounded by the two common electrodes 4*a* surrounding the activated individual electrodes 6 and the area functions as a heating element.

For example, to print with 200 dpi, the heating elements 3*a* are placed at 0.125-mm pitches. For A4-size recording paper, 1728 heating elements 3*a* are placed in a row.

Figure 3:
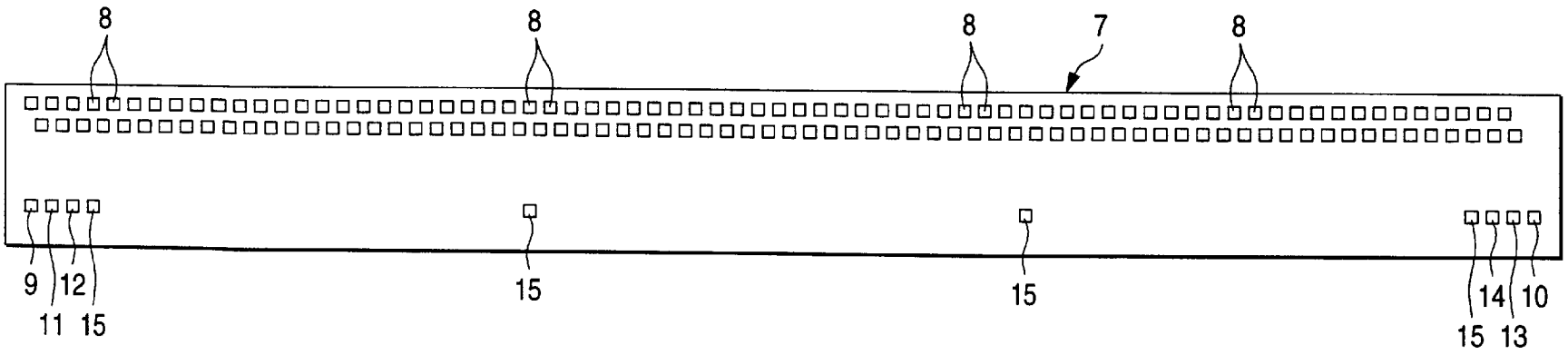
FIG. 3 is a plan view of a drive IC contained in the thermal print head shown in FIG. 1.

In the embodiment, 144-bit drive ICs 7 each for taking charge of a predetermined number of heating elements 3*a* and driving the heating elements 3*a* are used. That is, as shown in FIG. 3, 144 output pads 8 are placed as a staggered arrangement on the top face of one side end of the drive IC 7. Placed on the drive IC 7 are a data-in pad 9 for inputting print data, a data-out pad 10 for outputting print data, a latch pulse input pad 11 for inputting a latch signal, a clock pulse input pad 12 for inputting a clock signal, a strobe pulse input pad 13 for inputting a strobe signal, a logic power supply pad 14 for inputting a logic power supply, and a plurality of ground pads 15 as connection terminals in addition to the output pads 8.

To form the thermal print head 1 for A4-size recording paper shown in FIG. 1 having the 1728 heating elements 3*a*, 12 drive ICs 7 each of 144 bits are on the insulating substrate 2. The output pads 8 of each drive IC 7 and the wire-bonding pads 6*a* of each individual electrodes 6 are connected by wire bonding as known. Electrical conduction between the data-out pad 10 of one drive IC 7 and the data-in pad 9 of its adjacent drive IC 7 is provided by wire bonding to a wiring pattern (not shown) provided on the insulating substrate 2. The latch pulse input pads 11 of the drive ICs 7 are connected to wiring pattern (not shown) formed on the insulating substrate 2 by wire bonding in common. This also applies to the clock pulse input pads 12, the logic power supply pads 14, and the ground pads 15 of the drive ICs 7.

In FIG. 1, for example, the data-in pad 9 of the leftmost drive IC 7 is connected to a wiring pattern (not shown) to a data-in terminal provided on the insulating substrate 2 by wire bonding.

To activate the heating elements 3*a* in a time-divisional manner, the strobe pulse input pad 13 of each drive IC 7 is connected to either of two strobe signal wiring patterns (not shown) formed on the insulating substrate 2 by wire bonding. For example, the strobe pulse input pads 13 of the six drive ICs 7 positioned to the left of the center of the longitudinal direction of the insulating substrate 2 are connected to one strobe signal wiring pattern to which a first strobe signal STB1 is supplied and the strobe pulse input pads 13 of the six drive ICs 7 positioned to the right are connected to the other strobe signal wiring pattern to which a second strobe signal STB2 is supplied. That is, in the embodiment, the 1728 heating elements 3*a* on the insulating substrate 2 are divided into a left group and a right group each consisting of the 864 heating elements 3*a* and are activated in the two groups separately.

Figure 4:
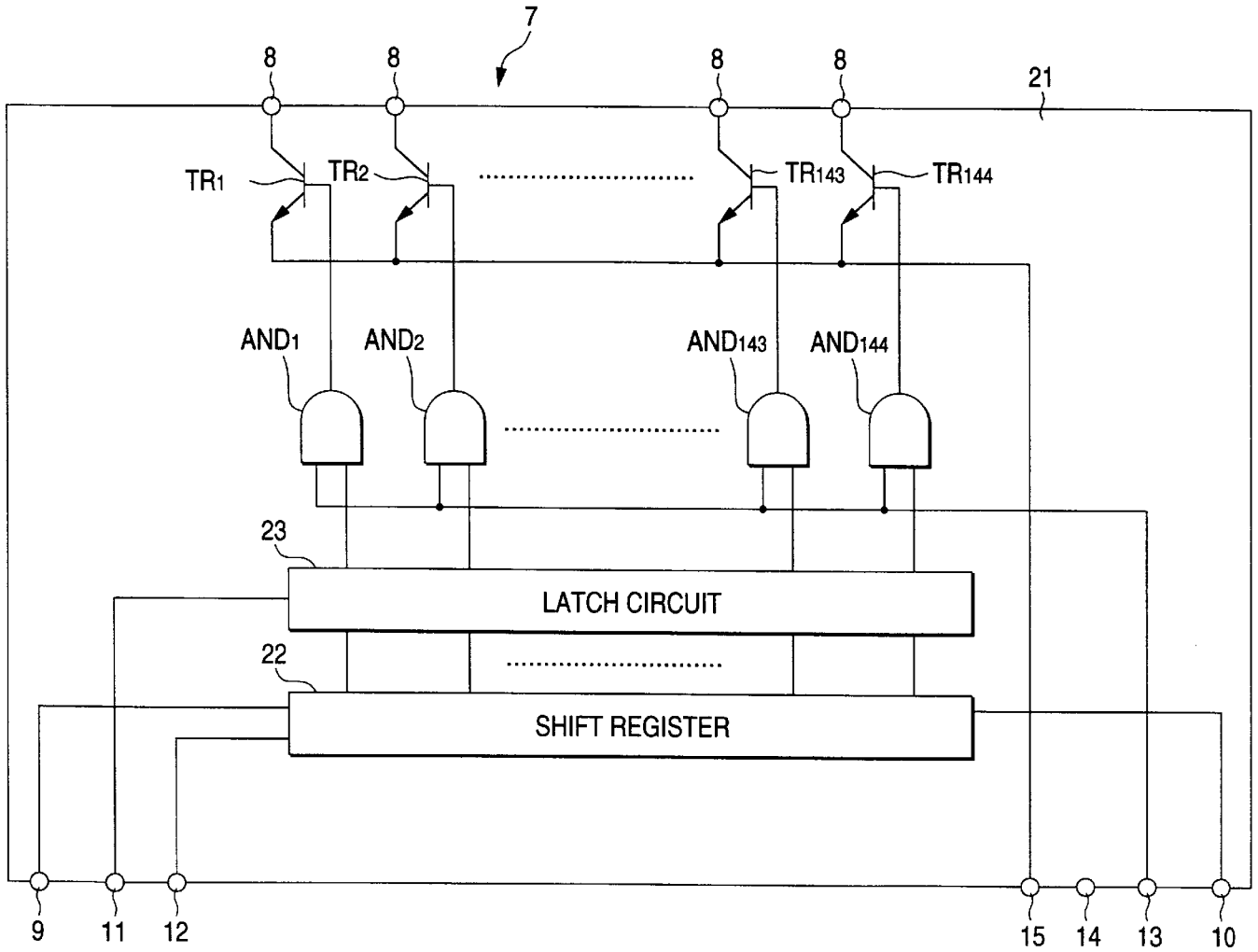
FIG. 4 is a circuit block diagram of the drive IC shown in FIG. 3.

The configuration of the drive IC 7 will be discussed below in more detail:

FIG. 4 is a circuit block diagram of the drive IC. A chip 21 of the drive IC 7 is formed with a 144-bit shift register 22, a 144-bit latch circuit 23, 144 AND circuits $AND_1$ to $AND_{144}$, and 144 bipolar transistors $TR_1$ to $TR_{144}$.

The bipolar transistors $TR_1$ to $TR_{144}$ have emitters connected to the ground pad 15 all in common, collectors connected to the output pads 8, and bases connected to output terminals of the AND circuits $AND_1$ to $AND_{144}$. One input terminal of each of the AND circuits $AND_1$ to $AND_{144}$ is connected to the corresponding output terminal of the latch circuit 23 and the other input terminal is connected to the strobe pulse input pad 13 in common. The latch circuit 23 has input terminals connected to output terminals of the shift register 22 and a latch signal input terminal connected to the latch pulse input pad 11. The shift register 22 has a serial input terminal connected to the data-in pad 9, a clock signal input terminal connected to the clock pulse input pad 12, and a serial output terminal connected to the data-out pad 10.

Figure 5:
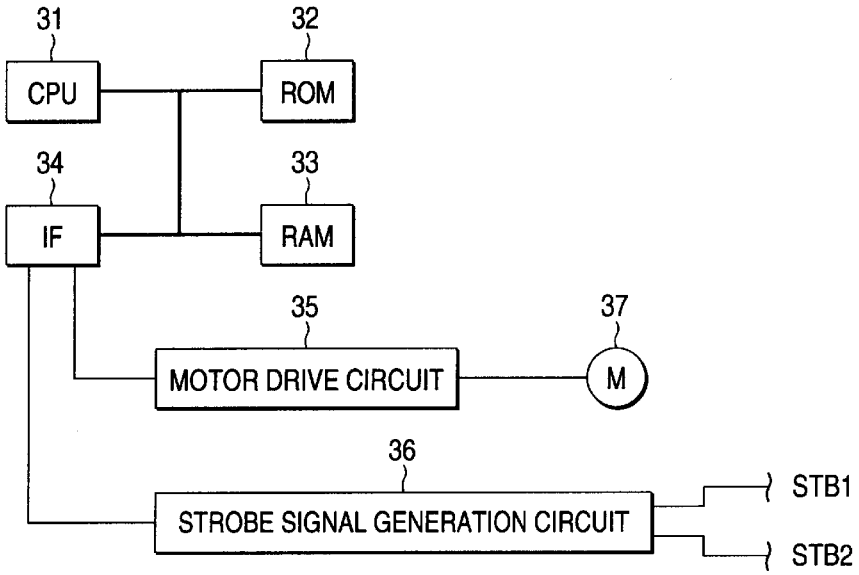
FIG. 5 is a circuit block diagram of a control section of the thermal printer according to the present invention.

FIG. 5 is a circuit block diagram of a control section of the thermal printer in the embodiment. The control section comprises a CPU (central processing unit) 31, ROM (read-only memory) 32, RAM (random access memory) 33, an interface circuit 34, a motor drive circuit 35, and a strobe signal generation circuit 36. The CPU 31, the ROM 32, the RAM 33, and the interface circuit 34 are connected to each other by buses including a data bus, an address bus, and a control bus. The motor drive circuit 35 and the strobe signal generation circuit 36 are connected to the interface circuit 34 and a stepping motor 37 is connected to the motor drive circuit 35.

The CPU 31 controls the whole thermal printer. The ROM 32 stores a program and data for operating the CPU 31. The RAM 33 provides 3 work area for the CPU 31 and stores various data such as print data input through the interface circuit 34 from the outside. The interface circuit 34 controls data input/output to/from the CPU 31. The motor drive circuit 35 supplies a motor driving pulse to the stepping motor 37 under the control of the CPU 31. The strobe signal generation circuit 36 supplies a first strobe signal STB1 to the strobe pulse input pads 13 of the left group of the six drive ICs 7 on the insulating substrate 2 and a second strobe signal STB2 to the strobe pulse input pads 13 of the right group of the six drive ICs 7 under the control of the CPU 31. The motor driving pulse is supplied from the motor drive circuit 35 to the stepping motor 37, which then turns a predetermined angle at a time for transporting recording paper in a direction opposite to a subscanning direction.

A latch signal is supplied by the CPU 31 to the latch pulse input pad 11 of each drive IC 7 through the interface circuit 34, a connector (not shown), etc. Print data is supplied from the RAM 33 to the data-in pad 9 of the leftmost drive IC 7 on the insulating substrate 2 through the interface circuit 34, connector (not shown), etc., under the control of the CPU 31. A clock signal is supplied from a clock pulse generation circuit (not shown) to the clock pulse input pad 12 of each drive IC 7 through connector (not shown), etc. A logic power supply is supplied from a power supply circuit (not shown) to the logic power supply pad 14 of each drive IC 7 through connector (not shown), etc.

That is, the stepping motor 37 forms an electric motor which turns at a predetermined angle for transporting recording paper in the direction opposite to the subscanning direction each time a driving pulse is input. The drive ICs 7 provide a plurality of drive integrated circuits each for activating a predetermined number of heating elements 3*a* during the turn-on period of the strobe signal. The CPU 31 and the strobe signal generation circuit 36 make up a strobe signal generation member for generating the strobe signals supplied to groups of the drive integrated circuits, while shifting the timings of the turn-on periods of the strobe signals in sequence for each group, and making the turn-on periods of the strobe signals adjacent in time sequence slightly overlap each other during the period each time the turn-on periods of the strobe signals pass once through all groups.

The operation is as follows: The print data input in series to the data-in pad 9 of the leftmost drive IC 7, namely, the drive IC 7 at the first stage on the insulating substrate 2 is input to the input terminal of the shift register 22, which then transfers the print data input in series to the first bit to the following bit in sequence in synchronization with a clock signal input through the clock pulse input pad 12. When another clock signal is input, the print data transferred to the last bit of the shift register 22 is output through the serial output terminal to the data-out pad 10 and is supplied to the data-in pad 9 of the drive IC 7 at the second stage through the wiring pattern on the insulating substrate 2. When the 144×12=1728-bit print data is thus stored in the shift registers 22 of the 12 drive ICs 7, the output terminals of the shift registers 22 go high or low in response to the corresponding bits of the print data.

When a latch signal is input to the latch signal input terminal of the latch circuit 23 through the latch pulse input pad 11 of each drive IC 7, the latch circuit 28 reads and stores the signal at the output terminals of the shift register 22 input to the input terminals, namely, the print data, whereby the output terminals of the latch circuit 23 go high or low in response to the corresponding bits of the print data. Therefore, the one input terminal of each of the AND circuits $AND_1$ to $AND_{144}$ goes high or low in response to the corresponding bit of the print data.

Figure 6:
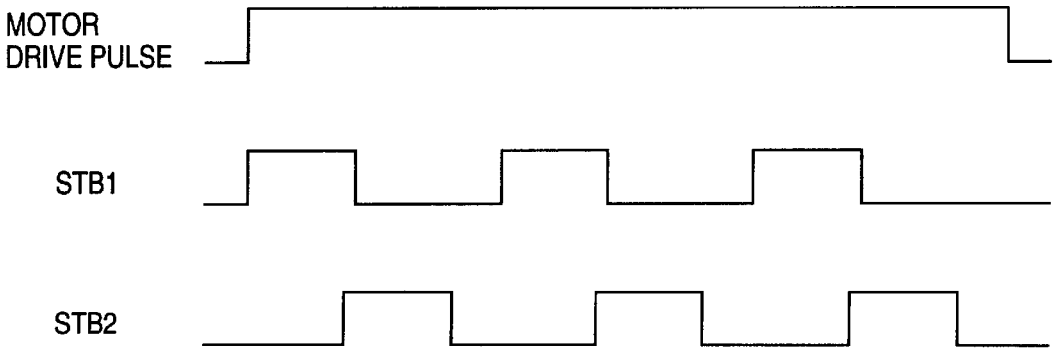
FIG. 6 is a timing chart of a motor driving pulse and strobe signals output from the control section of the thermal printer in a first embodiment of the present invention.

On the other hand, as shown in FIG. 6, the first strobe signal STB1 supplied to the strobe pulse input pads 13 of the left group of the six drive ICs 7 from the strobe signal generation circuit 36 is turned on at the same time as the rising edge of the motor driving pulse supplied from the motor drive circuit 35 to the stepping motor 37, whereby the other input terminal of each of the AND circuits $AND_1$ to $AND_{144}$ of the left group of the drive ICs 7 goes high. Therefore, the output terminals of the AND circuits of $AND_1$ to $AND_{144}$ corresponding to the bits output high from the latch circuit 23 in response to the print data go high. Resultantly, the corresponding bipolar transistors of $TR_1$ to $TR_{144}$ are turned on. The collectors of the bipolar transistors $TR_1$ to $TR_{144}$ are connected to the individual electrodes 6 in FIG. 2 through the output pads 8. Thus, if any of the bipolar transistors $TR_1$ to $TR_{144}$ is turned on, a closed loop from the anode of the power supply to the cathode of the same via the common terminal 5, the common wiring pattern 4, the common electrode 4*a*, the heating resistor 3, the individual electrodes 6, the corresponding one of the bipolar transistors $TR_1$ to $TR_{144}$ and the ground pad 15 is made, activating the corresponding one of the heating resistors 3 forming the heating element 3*a* for recording an image on the right half of recording paper.

When the second strobe signal STB2 supplied to the strobe pulse input pads 13 of the right group of the six drive ICs 7 from the strobe signal generation circuit 36 is turned on, similar operation to that in the turn-on period of the first strobe signal STB1 is performed for recording an image on the left half of recording paper. The rising edge of the second strobe signal STB2 is not simultaneous with the falling edge of the first strobe signal STB1 and is about 5–10 μsec ahead of the falling edge of the first strobe signal STB1. That is, the turn-on periods of the first and second strobe signals STB1 and STB2 overlap about 5–10 μsec considering the fact that the drive ICs 7 are configured so as to make the actual activating of the heating element 3*a* delay about 5–10 μsec from the time of the rising edge of the second strobe signal STB2 to suppress rapid change of the current output of the power supply circuit. As the turn-on periods of the first and second strobe signals STB1 and STB2 are thus made to overlap about 5–10 μsec, varying of the current output can be suppressed and intermittent output of the same can be prevented. Thereby, the power supply can be efficiently used. Namely, the overlap time of the strobe signals adjacent in time sequence is substantially equal to the delay time of the drive ICs 7.

The first strobe signal STB1 is turned on after a lapse of a predetermined time since the falling edge of the second strobe signal STB2, and the second-round activating is executed. Likewise, during one turn-on period of the motor driving pulse, the first and second strobe signals STB1 and STB2 are turned on alternately each three times and the heating elements 3*a* are activated six times separately for recording a one-line image.

To change the print density, the turn-on periods of the first and second strobe signals STB1 and STB2 may be changed. During one off period of the motor driving pulse, similar operation to that in the turn-on period is also performed for recording a one-line image.

Sequential activating of the left and right groups of the heating elements 3*a* is repeated three times every turn-on period of the motor driving pulse input to the stepping motor 37, so that high-quality recording can be executed regardless of speed variation of the stepping motor 37.

Since the turn-on periods of the first and second strobe signals STB1 and STB2 are made to overlap about 5–10 μsec, the varying of the output current can be suppressed extremely.

The first and second strobe signals STB1 and STB2 have completely the same waveform. Thus, the second strobe signal STB2 can be easily generated by delaying the first strobe signal STB1 a predetermined time.

Figure 7:
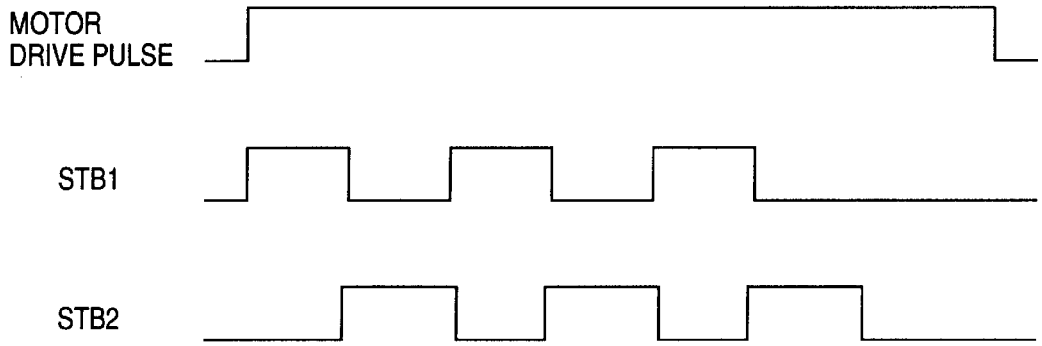
FIG. 7 is a timing chart of a motor driving pulse and strobe signals in second embodiment of the present invention.

In the first embodiment, the first strobe signal STB1 is turned on after a lapse of a predetermined time since the falling edge of the second strobe signal STB2. According to a second embodiment of the present invention, as shown in FIG. 7, the first strobe signal STB1 may be turned on about 5–10 μsec before the falling edge of the second strobe signal STB2. In doing so, the varying of the output current of the power supply circuit can be suppressed during the period from the first rising edge of the first strobe signal STB1 to the third falling edge of the second strobe signal STB2 while the turn-on period of the motor driving pulse. In this case, however, the turn-on period of the second strobe signal STB2 needs to be made longer about 10–20 μsec than the turn-on period of the first strobe signal STB1, and the first and second strobe signals STB1 and STB2 cannot be made the same waveform. To divide the heating elements 3*a* into three groups or more for sequentially activating the groups, the turn-on period of the strobe signal for activating the last group of the heating elements 3*a* may be made longer about 10–20 μsec than the turn-on period of any other strobe signal.

Figure 8:
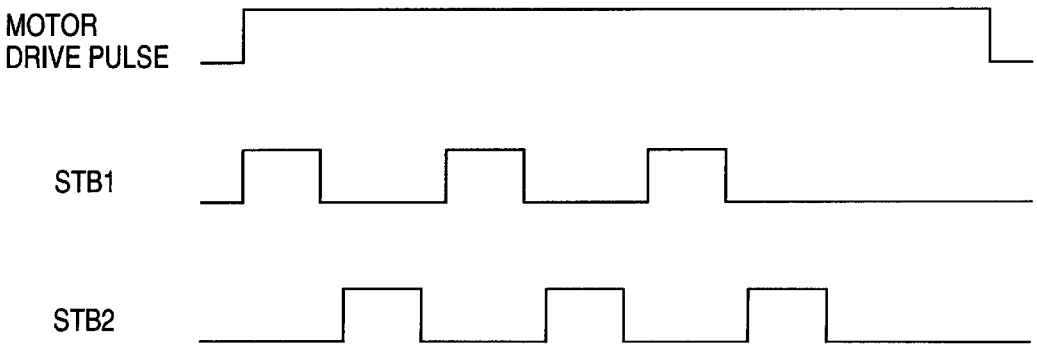
FIG. 8 is a timing chart of a motor driving pulse and strobe signals in third embodiment of the present invention.

According to a third embodiment of the present invention, as shown in FIG. 8, the turn-on period of the first strobe signal STB1 may be made not to overlap the turn-on period of the second strobe signal STB2.

The period in which both of the first strobe signal STB1 and the second strobe signal STB2 are made OFF means a period in which the power supply is not used substantially. It is thus possible to charge a condenser (not shown) connected between the power supply and the common terminal 5 while the above period. Therefore, also in this configuration, the power supply can be used efficiently.

Figure 9:
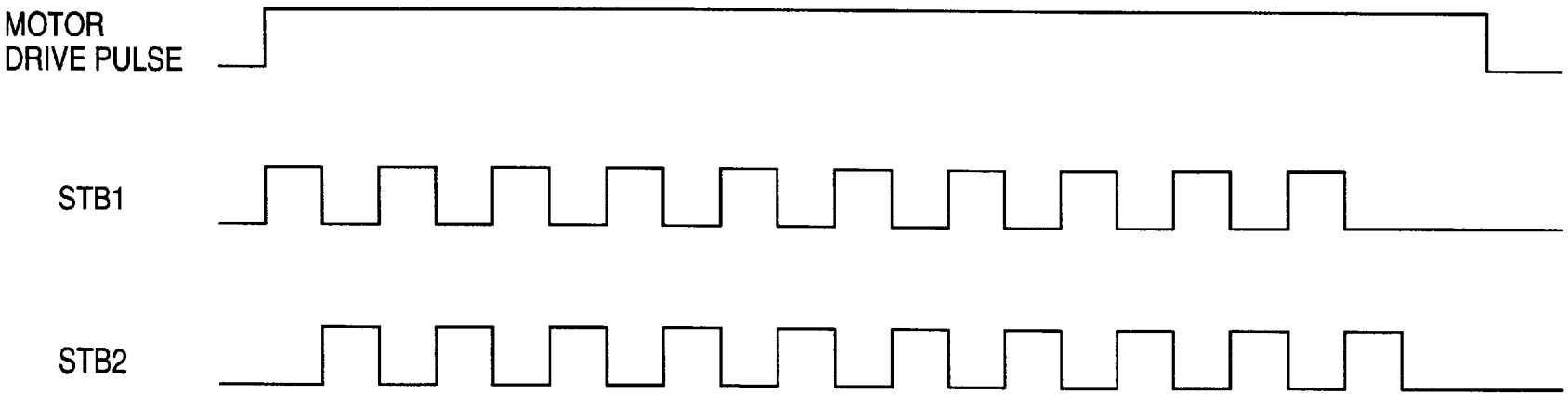
FIG. 9 is a timing chart of a motor driving pulse and strobe signals in fourth embodiment of the present invention.

In the above embodiments, sequential activating of the left and right groups of the heating elements 3*a* is repeated three times every turn-on period of the motor driving pulse. According to a fourth embodiment of the present invention, the sequential activating may be repeated 10 times as shown in FIG. 9. In short, sequential activating of all groups may be repeated twice or more; if the number of repetitions is too small, the recording density cannot sufficiently be rendered uniform and if the number of repetitions is too large, damage to the heat elements 3*a* caused by overheating the heat elements 3*a* increases. Thus, preferably the number of repetitions is about three to ten times.

Figure 10:
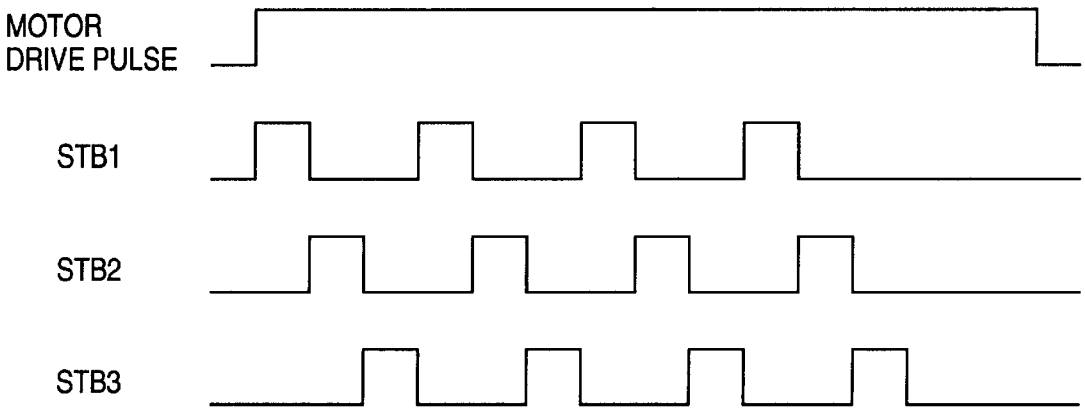
FIG. 10 is a timing chart of a motor driving pulse and strobe signals in fifth embodiment of the present invention.
Figure 11:
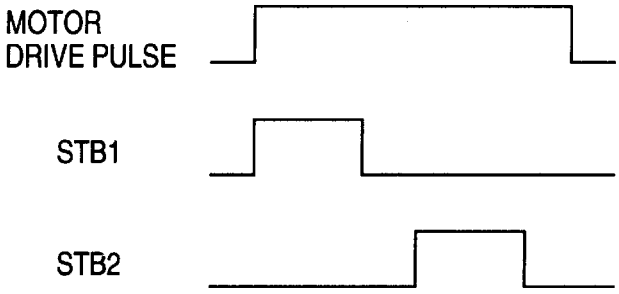
FIG. 11 is a timing chart of a motor driving pulse and strobe signals output from a control section of a thermal printer in a related art.
Figure 12:
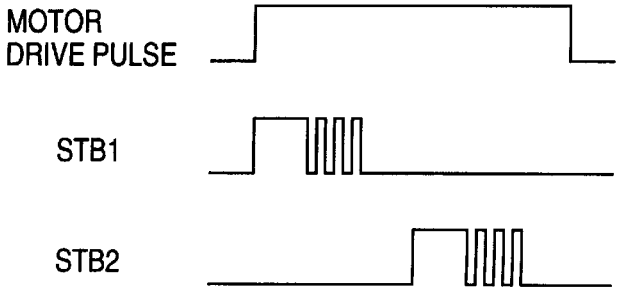
FIG. 12 is a timing chart of a motor driving pulse and strobe signals output from a control section of a thermal printer in another related art.

In the above embodiments, a large number of heating elements 3*a* are divided into two groups and the groups are activated in sequence. According to a fifth embodiment of the present invention, as shown in FIG. 10, first to third strobe signals STB1 to STB3 may be used so that a large number of heating elements 3*a* are divided into three groups for sequentially activating the groups. Of course, the heating elements 3*a* may be divided into four groups or more.

In the above embodiments, the first strobe signal STB1 is turned on simultaneously with the motor driving pulse is turned on. According to a sixth embodiment of the present invention, the first strobe signal STB1 may be turned on after the motor driving pulse is turned on.

When the stepping motor start to move while the motor driving pulse is turned on, there is occurred an eccentricity in a platen roller (not shown), which is rotated by the stepping motor and transports directly the recording paper to the direction opposite to the subscanning direction, along an axial direction thereof. Hence, there is a fear of occurring a shear in printing in the subscanning direction right after the stepping motor starts to move.

As the first strobe signal STB1 is turned on after a lapse of a predetermined time since the rising edge of the motor driving pulse and thereby the heating resistors 3 are activated, the image recording is conducted in a condition wherein the above eccentricity is canceled. Therefore, high quality image recording not including a position shift in the subscanning direction can be conducted. Namely, the above predetermined time should be selected as a period of time sufficient for the eccentricity of the platen roller is canceled.

In the above embodiments, all the strobe signal pulses have the same width with respect to all the sequential activating conducted during every turn-on period of the motor driving pulse. According to a seventh embodiment of the present invention, it may be configured that only the strobe signal pulse used for the first activating after the motor driving pulse is turn on is wider than those of any other pulses used for the subsequent activating.

The coloring on the recording paper is attained when the integral heat of the heating material exceeds a threshold level inherent in the recording paper. Making the width of the strobe signal pulse used for the first activating longer, there is obtained a longer activating time than any subsequent activating and thereby the image formation on the recording paper can be surely attained. The second and the latter subsequent activating are conducted for canceling the density unevenness in the direction perpendicular to the subscanning direction, thereby the quality of recording can be further improved.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A thermal printer comprising:

a plurality of heating elements for heating a recording medium to form an image thereon;

an electric motor for transporting the recording medium to a direction opposite to a subscanning direction by rotating a predetermined angle each time a driving pulse is input; and an activating control section for dividing the plural heating elements into a plurality of groups and for activating every group of the heating elements asynchronously such that the sequential activating of all the groups is repeated more than once during each time period the driving pulse is turned on.

2. The thermal printer as set forth in claim 1, wherein the number of repetition of the sequential activating is determined so the heating elements attain sufficient activating energy to form the image on the recording medium as a function of a resistance thereof and voltage applied thereto.

3. A thermal printer as set forth in claim 2, wherein the sequential activating of all the groups is repeated 3 to 10 times during each time period the driving pulse is turned on.

4. The thermal printer as set forth in claim 1, wherein the activating control section includes:

a plurality of drive circuit sections provided so as to correspond to the respective groups of the heating elements for activating the heating element used for forming the image while a strobe signal is turned on; and a strobe signal generating section for generating the strobe signal to be supplied to the respective drive circuit sections in sequence asynchronously.

5. The thermal printer as set forth in claim 4, wherein turn-on periods of the strobe signals adjacent in time sequence are overlapped with each other in a delay time of the drive circuit section while the strobe signals pass once through all the groups of the heating elements.

6. The thermal printer as set forth in claim 5, wherein the overlapped time is approximately 5–10 $\mu$sec.

7. The thermal printer as set forth in claim 5, wherein all the turn-on periods of the strobe signals are overlapped with each other in a delay time of the drive circuit section while the driving pulse is turned on.

8. The thermal printer as set forth in claim 5, wherein the strobe signal generating section supplies the first strobe signal to the drive circuit section after a lapse of a predetermined time since the driving pulse is tuned on.

9. The thermal printer as set forth in claim 8, wherein the strobe signal generating section supplies the first strobe signal to the drive circuit section after an eccentricity of a platen roller occurred when the platen roller is started to rotate by the electric motor to transport the recording medium.

10. The thermal printer as set forth in claim 5, wherein the strobe signal generating section supplies the first strobe signal having wider pulse width than those of any subsequent strobe signals while the driving pulse is tuned on.

11. The thermal printer as set forth in claim 10, wherein the pulse width of the first strobe signal is determined as a width necessary for attaining activating energy which is able to form the image on the recording medium.

12. The thermal printer as set forth in claim 5, wherein the strobe signal generating section generates each of the strobe signals supplied to the respective drive circuit sections by delaying one strobe signal.

13. The thermal printer as set forth in claim 4, wherein a predetermined length of turn-off period is provided between the strobe signals adjacent in time sequence.

14. The thermal printer as set forth in claim 1, wherein the activating control section charges a power supply during the turn-off period.

15. The thermal printer as set forth in claim 1, wherein the recording medium is heat-sensitive paper.

16. The thermal printer as set forth in claim 1, wherein the recording medium is normal paper, and the plural heating elements thermally transfer the image thereon through an ink ribbon.

17. The thermal printer as set forth in claim 1, wherein the plural thermal devices are arranged in a line to constitute a thermal head, and an area of the thermal head on which the plural thermal devices are mounted has a width substantially the same as that of the recording medium.

18. The thermal printer as set forth in claim 17, wherein each of the heating elements is defined by a line-shaped heating resistance disposed at one side end of the thermal head, comb-teeth-shaped common electrodes and an individual electrode arranged so as to be inserted between the common electrodes.

19. The thermal printer as set forth in claim 1, wherein the electric motor is a stepping motor.

* * * * *